United States Patent [19]

Lu et al.

[11] 4,411,975

[45] Oct. 25, 1983

[54] PARA-HALO PHENYL CARBOXYLIC ACID CHARGE ENHANCING ADDITIVES

[75] Inventors: Chin H. Lu, Webster; Christopher J. Au Clair, Fairport, both of N.Y.

[73] Assignee: Xerox Corporation, Stamford, Conn.

[21] Appl. No.: 367,194

[22] Filed: Apr. 12, 1982

[51] Int. Cl.[3] ..... G03G 9/08

[52] U.S. Cl. ..... 430/106; 430/110; 430/120; 430/126

[58] Field of Search ..... 430/108, 137, 110, 106, 430/120, 126

[56] References Cited

U.S. PATENT DOCUMENTS

| | | | |
|---|---|---|---|
| 3,609,082 | 9/1971 | Moriconi et al. | 252/62.1 |
| 3,884,825 | 5/1975 | Lindblad et al. | 252/62.1 |
| 3,893,935 | 7/1975 | Jadwin et al. | 252/62.1 |
| 4,073,739 | 2/1978 | Peters | 252/62.1 P |
| 4,248,954 | 2/1981 | Datta et al. | 430/108 |
| 4,298,672 | 11/1981 | Lu | 430/108 |

*Primary Examiner*—John E. Kittle

*Assistant Examiner*—John L. Goodrow

*Attorney, Agent, or Firm*—E. O. Palazzo

[57] ABSTRACT

This invention is directed to toner and developer compositions, as well as the use of such compositions in electrostatographic imaging systems, the toner composition being comprised of resin particles and pigment particles, and from about 0.1 percent to about 10 percent based on the weight of the toner particles, a para-halo phenyl carboxylic acid charge enhancing additive of the formula:

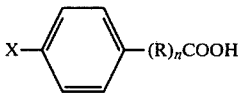

wherein X is a halogen, R is an alkylene group containing from 1 to about 3 carbon atoms, and n is the number zero or 1.

21 Claims, No Drawings

PARA-HALO PHENYL CARBOXYLIC ACID CHARGE ENHANCING ADDITIVES

BACKGROUND OF THE INVENTION

This invention is generally directed to new toner compositions, and new developer materials as well as the use of such compositions in electrostatographic imaging systems. More specifically, the present invention is directed to toner compositions containing para-halo phenyl carboxylic acids, and salts thereof, which additives impart a positive charge to the toner resin. Toner compositions, that is resin particles and pigment particles, containing the para-halo phenyl carboxylic acids, and salts of the present invention are useful in various electrostatographic imaging systems, including color imaging systems, especially those electrostatographic imaging systems employing Viton fuser roll components as more specifically detailed hereinafter.

Toner and developer compositions containing certain charge control additives, particularly for the purpose of imparting a positive charge toner resins is known in the art. Thus, for example, there is disclosed in U.S. Pat. No. 3,893,935 the use of specific quaternary ammonium compounds as charge control agents for electrostatic toner compositions. In accordance with the disclosure of this patent, certain quaternary ammonium compounds when incorporated into toner materials were found to provide a toner composition which exhibits a relatively high uniform and stable net toner charge when mixed with a suitable carrier vehicle. A similar teaching is contained in U.S. Pat. No. 4,079,014 with the exception that this patent describes positive charge control agents containing a diazo type material. Other charge control agents are also known, such as alkyl pyridinium compounds and their hydrates, disclosed in U.S. Pat. No. 4,298,672.

While many of the prior art charge control additives are suitable for specific purposes, there continues to be a need for the development of improved charge control additives. In particular, a number of the prior art charge control additives interact with certain fuser rolls used in electrostatographic imaging systems, such as Viton fuser rolls, which causes such rolls to be adversely affected, thereby resulting in the deterioration of image quality. For example, Viton fuser rolls discolor and turn black as well as develop multiple surface cracks when certain prior art charge control additives are employed in the toner mixture. Further, some of the prior art charge control agents do not have the appropriate admixing times over extended periods.

One Viton fuser roll used in electrostatographic copying machines, particularly xerographic copying systems, is comprised of a soft roll fabricated from lead oxide and duPont Viton E-430 resin (a vinylidene fluoridehexafluoropropylene copolymer). This roll can be prepared by blending together followed by curing on a soft roll, approximately 15 parts by weight of lead oxide, and 100 parts by weight of Viton E-430. Apparently, the function of the lead oxide is to generate unsaturation by dehydrofluorination for cross-linking, and to provide release mechanisms for the toner composition. Excellent image quality has been obtained with the use of Viton fuser rolls, however, in some instances, there is toner fuser compatibility problems, when charge enhancing additives are part of the toner mixture. Thus, for example, it appears that certain charge control additives, such as quaternary ammonium compounds, and some alkyl pyridinium compounds, react with the Viton fuser roll. For example, an alkyl pyridinium chloride, such as cetyl pyridinium chloride when part of the toner mixture, appears to be catalytically decomposed by the lead oxide contained in the fuser roll, resulting in a higher unsaturated compound, which polymerizes and condenses with the unsaturated Viton. As a result, the Viton fuser roll turns black and develops multiple surface cracks resulting in image quality deterioration.

Some of the prior art charge enhancing additives while suitable for toner compositions to be utilized in the development of black images, may also not be suitable for the development of colored electrostatic latent images. Accordingly, there continues to be a need for toners and developer compositions which contain improved charge enhancing additives, and which compositions can be utilized for the development of electrostatic latent images, including the development of electrostatic color images. Further, there continues to be a need for positively charged toner materials for use in electrostatographic imaging systems employing Viton type fuser rolls, in order that high quality images can be produced over extended periods of time without adversely affecting such rolls. Additionally, there continues to be a need for toner and developer compositions which will rapidly charge new uncharged toner compositions being added to the charged developer, which toners are humidity insensitive as well as being compatible with Viton fuser rolls. There also continues to be a need for toner and developer compositions which possess high positive triboelectric charging properties for extended periods of time.

SUMMARY OF THE INVENTION

It is therefore an object of the present invention to provide a toner composition which overcomes the above-noted disadvantages.

It is a further object of the present invention to provide a toner composition, and a developer composition, which contains toner particles and carrier particles, with the toner particles being charged positively.

Another object of the present invention is the provision of positively charged toner particles having improved admix charging and improved humidity sensitivity, while simultaneously being compatible with Viton fuser rolls.

It is yet another object of the present invention to provide developer compositions which can be employed in color imaging systems.

An additional object of the present invention is the provision of toner compositions, which will develop electrostatic images, including color images, containing negative charges on the imaging member surface, and which will transfer effectively electrostatically from such a surface to plain bond paper, without causing blurring, or adversely affecting the quality of the resulting images, particularly when such toners are used with Viton type fuser roll systems.

These and other objects of the present invention are accomplished by providing a toner composition, and a developer composition comprised of positively charged resin particles, colorant or pigment particles, carrier particles, and as a charge enhancing additive a para-halo phenyl carboxylic acid and salts thereof of the following formula:

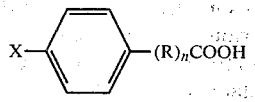

wherein X is a halogen such as fluoride, chloride, or bromide, R is an alkylene radical containing from 1 to about 3 carbon atoms, and n is the number zero (0) or 1. As illustrated, it is important that the charge enhancing carboxylic acids and salts thereof contain the halogen X group in the para, or 4 position relative to the carboxylic acid group, or alkyl substituted carboxylic acid group.

Illustrative examples of the X radicals include fluoride, chloride, and bromide as indicated hereinbefore, while examples of the R alkylene radicals include methylene, ethylene, propylene, and the like when n is equal to 1. Preferred charge enhancing additives include those wherein X is fluoride or chloride, and n is zero, and salts thereof, including the ammonium, zinc, calcium, potassium and sodium salts.

Illustrative examples of specific para-halo carboxylic acids and salts thereof embraced within the present invention include 4-fluorobenzoic acid, 4-chlorobenzoic acid, 4-bromobenzoic acid, 4-fluorophenyl acetic acid, 4-fluorophenyl propionic acid, 4-fluorobutyric acid, 4-chlorophenyl acetic acid, as well as the corresponding ammonium, sodium, potassium, calcium and zinc salts thereof. The preferred charge enhancing additive of the present invention is para-fluorobenzoic acid.

The para-halo phenyl carboxylic acid charge enhancing additives of the present invention are utilized in amounts that do not adversely affect the imaging system in which they are employed, and result in a toner composition that is charged positively in comparison to the carrier particles. For example, the amount of charge enhancing additive of the present invention can range from about 0.1 percent by weight to about 10 percent by weight of the toner particles, and preferably from about 0.5 percent by weight to about 5 percent by weight of the toner particles. In one preferred embodiment, the charge enhancing additives of the present invention are present in an amount of from about 1 percent by weight to about 3 percent by weight.

The para-halo pheny carboxylic acid charge enhancing additives of the present invention can either be blended into the toner composition, or coated on the colorant or pigment employed therein, such as carbon black, cyan pigment, magenta pigment or yellow pigment. When the charge enhancing additive is employed as a pigment coating, the amount present ranges from about 2 percent by weight to about 20 percent by weight, and preferably from about 5 percent by weight to about 10 percent by weight based on the weight of the pigment particles.

A number of known methods may be employed for producing the toner and developer particles of the present invention, one method involving melt blending the toner resin and the pigment particles coated with the charge enhancing additive of the present invention, followed by mechanical attrition. Other methods include those well known in the art, such as spray drying, melt dispersion, dispersion polymerization and suspension polymerization. In dispersion polymerization, a solvent dispersion of the resin-pigment particles and the para-halo phenyl carboxylic acid, or salts thereof, of the present invention are spray dried under controlled conditions resulting in the desired product. A toner composition prepared in this manner results in a positively charged toner in relationship to the carrier materials, and these materials exhibit the improved properties as mentioned hereinbefore.

Various suitable resins can be employed together with the charge enhancing additives of the present invention, typical resins being for example polyamides, epoxies, polyurethanes, vinyl resins, and polyesters, especially those prepared from dicarboxylic acids and diols comprising diphenols. Any suitable vinyl resin may be employed in the toners of the present system, including homopolymers or copolymers of two or more vinyl monomers. Typical of such vinyl monomeric units include: styrene, p-chlorostyrene, vinyl naphthalene, ethylenically unsaturated mono-olefins such as ethylene, propylene, butylene, isobutylene and the like; vinyl halides such as vinyl chloride, vinyl bromide, vinyl fluoride, vinyl esters such as vinyl acetate, vinyl propionate, vinyl benzoate, vinyl butyrate and the like; esters of aliphamethylene aliphatic monocarboxylic acids such as methyl acrylate, ethyl acrylate, n-butylacrylate, isobutyl acrylate, dodecyl acrylate, n-octyl acrylate, 2-chloroethyl acrylate, phenyl acrylate, methylalphachloroacrylate, methyl methacrylate, ethyl methacrylate, butyl methacrylate and the like; acrylonitrile, methacrylonitrile, acrylamide, vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl indole, N-vinyl pyrrolidene and the like; and mixtures thereof.

Generally toner resins containing a relatively high percentage of styrene are preferred. The styrene resin employed may be a homopolymer of styrene, or styrene homologs of copolymers of styrene with other monomeric groups. Any of the above typical monomeric units may be copolymerized with styrene by addition polymerization. Styrene resins may also be formed by the polymerization of mixtures of two or more unsaturated monomeric materials with a styrene monomer. The addition polymerization technique employed embraces known polymerization techniques such as free radical, anionic, and cationic polymerization processes. Any of these vinyl resins may be blended with one or more resins if desired, preferably other vinyl resins, which insure good triboelectric properties and uniform resistance against physical degradation. However, non-vinyl type thermoplastic resins may also be employed including resin modfified phenolformaldehyde resins, oil modified epoxy resins, polyurethane resins, cellulosic resins, polyether resins, and mixtures thereof. Optimum electrophotographic resins are achieved with styrene butylmethacrylate copolymers, styrene vinyl toluene copolymers, styrene acrylate copolymers, polyester resins, predominantly styrene or polystyrene base resins as generally described in U.S. Pat. No. Re. 25,136, polystyrene blends as described in U.S. Pat. No. 2,788,288, and styrene-butadiene resins.

Also esterification products of a dicarboxylic acid, and a diol comprising a diphenol may be used as a preferred resin material for the toner composition of the present invention. These materials are illustrated in U.S. Pat. No. 3,655,374 the disclosure of which is totally incorporated herein by reference, the diphenol reactant being of the formula as shown in Column 4, beginning at line 5, of this patent, and the dicarboxylic acid being of the formula as shown in Column 6 of the above patent.

The toner resins are present in an amount so that the total of all toner ingredients is equal to about 100 percent, thus when 5 percent by weight of the charge enhancing additive is present, and 10 percent by weight of a pigment or colorant, such as carbon black is present, about 85 percent by weight of resin material is included therein.

With regard to toner compositions useful for the production of primarily black images, various well known suitable pigments or dyes are added to the toner resin, such materials including for example carbon black, magnetite, iron oxides, nigrosine dye, chrome yellow, ultramarine blue, duPont oil red, methylene blue chloride, phthalocyanine blue, and mixtures thereof. The pigment or dye should be present in the toner in sufficient quantity to render it highly colored, thus providing for the formation of a clearly visible image. For example, where conventional xerographic copies of documents are desired, the toner may comprise a black pigment, such as carbon black, or a black dye such as Amaplast black dye available from the National Aniline Products, Inc. Preferably the pigment is employed in amounts of from about 3 percent to about 50 percent by weight based on the total weight of toner, however, if the pigment employed is a dye, substantially smaller quantities, for example less than 10 percent by weight, may be used.

With regard to the production of color images utilizing the developer particles containing the charge enhancing additives of the present invention, there is employed as the colorant magenta, cyan, and/or yellow pigments, as well as mixtures thereof. Illustrative examples of magenta materials that may be used as pigments, include for example, 2,9-dimethyl-substituted quinacridone and anthraquinone dye identified in the color index as CI 60710, CI Dispersed Red 15, a diazo dye identified in the color index as CI 26050, CI Solvent Red 19, and the like. Illustrative examples of cyan materials that may be used as pigments include copper tetra-4(octadecyl sulfonomido) phthalocyanine, X-copper phthalocyanine pigment listed in the color index as CI 74160, CI Pigment Blue, and Anthradanthrene Blue, identified in the color index as CI 69810, Special Blue X-2137, and the like, while illustrative examples of yellow pigments that may be employed include diarylide yellow 3,3-dichlorobenzidene acetoacetanilides, a monoazo pigment identified in the color index as CI 12700, CI Solvent Yellow 16, a nitrophenyl amine sulfonamide identified in the color index as Foron yellow SE/GLN, CI dispersed yellow 33, 2,5-dimethoxy-4-sulfonanilide phenylazo-4'-chloro-2,5-dimethoxy acetoacetanilide, permanent yellow FGL, and the like.

The color pigments, namely, cyan, magenta, and yellow pigments when utilized with the charge enhancing additives of the present invention are generally present in an amount of from about 2 weight percent to about 20 weight percent, and preferably from about 5 weight percent to about 15 weight percent based on the weight of the toner resin particles.

Various suitable carrier particles can be employed in formulating the developer compositions of the present invention (toner plus carrier) providing that they are capable of triboelectrically obtaining a charge of polarity opposite to that of the toner particles. In the present invention in one embodiment that would be a negative polarity, thus causing the toner particles to adhere to, and surround the carrier particles. Thus, the carrier particles are selected so as to cause the toner particles to acquire a charge of a positive polarity, and include materials such as sodium chloride, ammonium chloride, Rochelle salt, sodium nitrate, potassium chlorate, granular zircon, granular, silicon, methylmethacrylate, glass, steel, nickel, iron ferrites, silicon dioxide, and the like, with metallic carriers especially magnetic carriers being preferred. The carriers can be used with or without a coating. The coatings generally contain polyvinyl fluoride resins, but other resins especially those which charge negatively, such as polystyrene, halogen containing ethylenes and the like can be used. Many of the typical carriers that can be used are described in U.S. Pat. Nos. 2,618,441; 3,533,835; and 3,526,533. Also nickel berry carriers as described in U.S. Pat. Nos. 3,847,604 and 3,767,598 can be employed, these carriers being nodular carrier beads of nickel characterized by surfaces of reoccurring recesses and protrusions providing particles with a relatively large external areas. The diameter of the coated carrier particle is from about 50 to about 1000 microns, thus allowing the carrier to possess sufficient density and inertia to avoid adherence to the electrostatic images during the development process.

The carrier particles may be employed with the toner composition in various suitable combinations, however, best results are obtained when about 1 part by weight of toner particles to about 10 to about 200 parts by weight of carrier particles are utilized.

The toner and developer compositions of the present invention may be used to develop electrostatic latent images, including color images on various suitable imaging surfaces capable of retaining charge including, for example, conventional photoreceptor surfaces known in the art, such as inorganic photoconductors, like selenium, and layered organic photoresponsive devices, wherein a negative charge resides on the photoreceptor surface, which usually occurs with organic photoreceptor devices, which method comprises contacting the electrostatic latent image with the developer composition of the present invention, followed by transferring the resulting image to a suitable substrate, and optionally permanently affixing the image, by for example, heat. Examples of such devices include organic layered devices comprised of a substrate, a generating layer and a transport layer as described in U.S. Pat. No. 4,265,990, the disclosure of which is totally incorporated herein by reference, layered photoresponsive devices such as those comprised of a substrate, overcoated with a hole injecting layer, which is overcoated with a hole transport layer, followed by overcoatings of a hole generating layer and a top coating of an organic insulating resin, as disclosed in U.S. Pat. No. 4,251,612, the disclosure of which is totally incorporated herein by reference. Illustrative examples of preferred generating layers include trigonal selenium and vanadyl phthalocyanine, while examples of preferred transport layers include diamines dispersed in resins such as those diamines specifically disclosed in U.S. Pat. No. 4,265,990, and the like. Examples of other organic photoresponsive devices which may be employed in the imaging method of the present invention include polyvinylcarbazole, 4-dimethylaminobenzylidene, benzyhydrazide, 2-benzylidene-amino-carbazole, polyvinylcarbazole; (2-nitro-benzylidene)p-bromoaniline; 2,4-diphenylquinazoline; 1,2,4-triazine, 1,5-diphenyl-3 methyl pyrazoline 2-(4'dimethyl-amino phenyl)-benzoxazole; 3-amino-carbazole; polyvinylcarbazole-trinitrofluorenone charge transfer complex; phthalocyanines and mixtures thereof.

The following examples are being supplied to further define certain embodiments of the present invention, it being noted that these examples are intended to be illustrative only, and are not intended to limit the scope of the present invention. Parts and percentages are by weight unless otherwise indicated.

EXAMPLE I

There was prepared two toner compositions, containing resin particles and no pigment particles, one designated a control composition, by melt blending followed by mechanical attrition. Subsequently the toner compositions were classified to remove particles below 5 microns.

Control toner composition A contained 100 percent of a styrene/n-butylmethacrylate copolymer resin, 58 percent by weight of styrene and 42 percent by weight of n-butylmethacrylate.

The second toner composition B, contained 98 percent by weight of a styrene/n-butylmethacrylate copolymer resin, 58 percent by weight of styrene, and 42 percent by weight of n-butylmethacrylate, and 2 percent of the charge enhancing additive para-fluorobenzoic acid (PFBA) of the following formula:

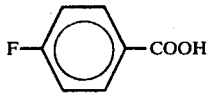

para-fluorobenzoic acid (PFBA)

The triboelectric charges on the above identified toner compositions were measured utilizing a Faraday cage, against carrier particles containing a ferrite core coated with 0.5 percent by weight of a methyl methacrylate, styrene, silane terpolymer, which triboelectric values were measured at a toner concentration of 2 percent, with the following results:

| Toner | Charge Control Additive % | Toner Tribo Microcoulombs per gram (uc/g) 10 min | 60 min | 180 min | 300 min |
|---|---|---|---|---|---|
| A (control) | 0 | −5 | −10 | −15 | −17 |
| B | 2% PFBA | +19 | +38 | +53 | +44 |

As shown by the above-identified data, toner composition A containing no para-fluorobenzoic acid possessed a negative charge against the ferrite material while toner B containing 2 percent by weight of para-fluorobenzoic acid, had a positive charge ranging from +19 to +44 over a period of from 10 minutes to 300 minutes, against the same carrier material.

Additionally, the para-fluorobenzoic acid (PFBA) charge enhancing additive, about 2 grams was placed on a piece of Viton E-430 rubber, available from E. I. duPont Company, in a 1 cm area in diameter, and covered with a watch glass plate. This entire material was then placed in an oven, and heating was accomplished for 30 minutes at 200° C. Subsequent to heating the watch glass was removed and the para-fluorobenzoic acid was washed off with methanol. The Viton E-430 rubber was then visually examined for discoloration and spots, and no noticable discoloration or spots were observed, indicating that the para-fluorobenzoic acid had no damaging affects on the Viton rubber.

EXAMPLE II

The procedure of Example I was repeated with the exception that two green toner compositions were prepared. Again the toner compositions were classified to remove particles below 5 microns and the toners involved are identified in this example as control toner composition C, and toner composition D which contains the charge enhancing additive para-fluorobenzoic acid (PFBA).

Toner C or the control toner contained 2 percent by weight of the cyan pigment copper tetra-4(octadecyl-sulfonomido)phthalocyanine, 4 percent of the yellow pigment 2,5-dimethoxy-4-sulfonanilide phenylazo-4'-chloro-2,5-dimethoxy acetoacetanilide, permanent yellow FGL, and 94 percent by weight of the styrene/n-butylmethacrylate resin of Example I.

Toner D contained two percent by weight of the cyan pigment copper tetra-4(octadecyl-sulfonomido)phthalocyanine, 4 percent by weight of yellow pigment 2,5-dimethoxy-4-sulfonanilide phenylazo-4'-chloro-2,5-dimethoxy acetoacetanilide, permanent yellow FGL, 92 percent by weight of the styrene/n-butylmethacrylate resin of Example I, and 2 percent by weight of the charge enhancing additive para-fluorobenzoic acid.

The triboelectric properties of these toner compositions were measured using a Faraday cage, against a carrier particle comprised of a ferrite core coated with 0.5 percent of a methyl methacrylate terpolymer, reference U.S. Pat. No. 3,526,533, such measurements being accomplished at 2 percent by weight toner concentration with the following results:

| Toner | Charge Control Additive % | Toner Tribo Microcoulombs per gram (uc/g) 10 min | 60 min | 180 min | 300 min |
|---|---|---|---|---|---|
| C (control) | 0 | −11 | −6 | −5 | −4 |
| D | 2% (PFBA) | +5 | +24 | +33 | +38 |

Toner composition C which did not contain any charge enhancing additive, had a negative triboelectric charge, whereas toner D which contain 2 percent of the charge control additive had a positive charge against the same carrier materials.

EXAMPLE III

There was prepared two black toner compositions in accordance with the process of Example I, which toners were further classified to remove particles below 5 microns. These toner compositions were identified as control toner composition E, and toner composition F.

Toner composition E, contained 94 percent by weight of the styrene/n-butylmethacrylate resin of Example I, and 6 percent by weight of Regal 330 carbon black, white toner composition F contained 92 percent by weight of the styrene/n-butylmethacrylate resin of Example I, 6 percent by weight of Regal 330 carbon black, and 2 percent by weight of para-fluorobenzoic acid (PFBA).

The triboelectric properties of the above prepared toner compositions were then measured with a Faraday cage, utilizing carrier particles containing a Hoeganaes steel carrier core, coated with 0.2 percent Kynar 301, commercially available from Pennwalt Corporation as polyvinylidene fluoride, at 2 percent by weight toner concentration with the following results:

| Toner | Charge Control Additive % | Toner Tribo Microcoulombs per gram (uc/g) 10 min | 60 min | 180 min | 300 min |
|---|---|---|---|---|---|
| E(Control) | 0 | +27 | +21 | +13 | +2 |
| F | 2% (PFBA) | +43 | +49 | +45 | +45 |

Toner composition F which contained 2 percent by weight of the para-fluorobenzoic acid charge enhancing additive had significantly higher positive charges than control toner E.

EXAMPLE IV

There was prepared a green toner composition, toner G, in accordance with the process described in Example I. Toner G contained 2 percent by weight of 4-fluorophenyl acetic acid (4 FPAA), as a charge enhancing additive, 2 percent by weight of the cyan pigment copper tetra-4(octadecyl-sulfonomido) phthalocyanine, 4 percent by weight of the yellow pigment 2,5-dimethoxy-4-sulfonanilide phenylazo-4'-chloro-2,5-dimethoxy acetoacetanilide, permanent yellow FGL, and 92 percent by weight of the styrene/n-butylmethacrylate resin of Example I. The chemical structure of the phenyl acetic acid charge enhancing additive is as follows:

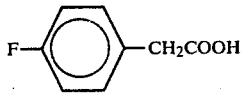

4-fluorophenyl acetic acid. (4 FPAA)

The triboelectric properties of this toner composition, toner G, were measured in accordance with Example II and these measurements were compared with the control toner of Example II, namely toner C, with the following results:

| Toner | Charge Control Additive % | Toner Tribo Microcoulombs per gram (uc/g) 10 min | 60 min | 180 min | 300 min |
|---|---|---|---|---|---|
| C (control) | 0 | −11 | −6 | −5 | −4 |
| G | 2% (4 FPAA) | +50 | +58 | +54 | +53 |

Toner compositions G which contain 2 percent of 4FPAA as a charge control additive, displayed much higher positive charge in comparison to control toner C.

EXAMPLE V

Developer compositions were prepared by mixing together 1 part by weight of the toner compositions of Examples I to IV, containing the charge enhancing additives specified, with 100 parts by weight of carrier particles consisting of a ferrite core coated with 1.2 percent by weight of polyvinyl fluoride.

The resulting developer compositions were then utilized to develop latent electrostatic images formed on a layer photoresponsive device charged negatively, which device contained a substrate, overcoated with a photogenerating layer of trigonal selenium, which in turn was overcoated with a transport layer comprised of the diamine N,N'-diphenyl-N,N'-bis(3-methyl phenyl)1,1'-biphenyl-4,4'-diamine in a polycarbonate binder, reference U.S. Pat. No. 4,265,990, and there was obtained in each instance high quality images of excellent resolution and good solid area density.

Other modifications of the present invention may occur to those skilled in the art based upon a reading of the present disclosure and these are intended to be included within the scope of the present invention; thus colored xerographic images can be developed in accordance with the process described in U.S. Pat. No. 4,311,932, the disclosure of which is totally incorporated herein by reference.

We claim:

1. A dry positively charged toner composition comprised of resin particles and pigment particles, and from about 0.1 percent to about 10 percent based on the weight of the toner particles, a para-halo phenyl carboxylic acid charge enhancing additive of the formula:

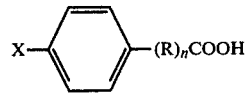

wherein X is a halogen, R is an alkylene group containing from about 1 to about 3 carbon atoms, and n is the number zero or 1.

2. A toner composition in accordance with claim 1 wherein the halogen is fluoride, chloride or bromide, the alkylene group is methylene, and n is 1.

3. A toner composition in accordance with claim 1 wherein n is zero and X is fluoride.

4. A toner composition in accordance with claim 1 wherein the charge enhancing additive is para-fluorobenzoic acid.

5. A toner composition in accordance with claim 4 wherein n is 1 and the charge enhancing additive is 4-fluorophenyl acetic acid.

6. A developer composition comprised of positively charged toner particles, and carrier particles, the toner particles being comprised of resin particles and pigment particles, said developer composition further including from about 0.1 percent to about 10 percent based upon the weight of the toner particles of a para-halo phenylcarboxylic acid charge enhancing additive of the formula:

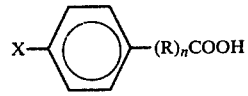

wherein X is halogen, R is an alkylene group containing from 1 to about 3 carbon atoms, and n is the number zero or 1.

7. A developer composition in accordance with claim 6 wherein X is fluoride, and R is methylene.

8. A developer composition in accordance with claim 6 wherein n is zero.

9. A developer composition in accordance with claim 6 wherein X is chlorine.

10. A developer composition in accordance with claim 6 wherein the charge enhancing additive is para-fluorobenzoic acid.

11. A developer composition in accordance with claim 6 wherein n is 1 and the charge enhancing additive is 4-fluorophenyl acetic acid.

12. A method of developing electrostatic latent images comprising forming a negative electrostatic latent image on a photoresponsive device, contacting the resulting image with a developer composition comprised of positively charged toner particles and carrier particles, the toner particles being comprised of resin particles, pigment particles, and from about 0.1 percent to about 10 weight percent based on the weight of the toner particles of a para-halo phenyl carboxylic acid charge enhancing additive of the formula

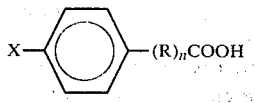

wherein X is halogen, R is an alkylene group containing from 1 to about 3 carbon atoms, and n is the number zero or 1, followed by transferring the image to a suitable substrate, and permanently affixing the image thereto.

13. A method of imaging in accordance with claim 12 wherein the charge enhancing additive is para-fluorobenzoic acid.

14. A method of imaging in accordance with claim 12 wherein n is 1 and the charge enhancing additive is 4-fluorophenyl acetic acid.

15. A method of imaging in accordance with claim 12 wherein the pigment particles are carbon black.

16. A method of imaging in accordance with claim 12 wherein the pigment particles are selected from cyan pigments, magenta pigments, and yellow pigments.

17. A toner composition in accordance with claim 1 wherein the resin particles are comprised of styrene/n-butylmethacrylate, and the pigment particles are carbon black.

18. A toner composition in accordance with claim 1 wherein the pigment particles are selected from cyan pigments, magenta pigments and yellow pigments.

19. A developer composition in accordance with claim 6 wherein the carrier particles are comprised of a ferrite core coated with a methyl methacrylate, styrene, silane terpolymer.

20. A toner composition in accordance with claim 18 wherein the cyan pigment is copper tetra-4(octadecyl-sulfonomido)phthalocyanine, the yellow pigment is 2,5-dimethoxy-4-sulfanilide phenylazo-4'-chloro-2,5-dimethoxy acetoacetanilide.

21. A toner composition in accordance with claim 1 wherein the pigment particles contain the cyan pigment copper tetra-4(octadecyl-sulfonomido phthalocyanine, present in an amount of 2 percent by weight, and 4 percent by weight of the yellow pigment 2,4-dimethoxy-4-sulfonanilide phenylazo-4''-chloro-2,5-dimethoxy acetoacetanilide, and wherein the resin particles contain 92 percent by weight of a styrene/n-butylmethacrylate resin, and 2 percent by weight of the charge enhancing additive para-fluorobenzoic acid.

* * * * *